US009175935B2

(12) United States Patent
Gordon

(10) Patent No.: US 9,175,935 B2
(45) Date of Patent: Nov. 3, 2015

(54) SHOOTING TRAINING ASSEMBLY WITH INFRARED PROJECTION

(71) Applicant: Noel Gordon, Wangaratta (AU)

(72) Inventor: Noel Gordon, Wangaratta (AU)

( * ) Notice: Subject to any disclaimer, the term of this patent is extended or adjusted under 35 U.S.C. 154(b) by 17 days.

(21) Appl. No.: 13/783,609

(22) Filed: Mar. 4, 2013

(65) Prior Publication Data

US 2014/0248587 A1 Sep. 4, 2014

(51) Int. Cl.

| | |
|---|---|
| ***F41J 2/02*** | (2006.01) |
| ***F41J 5/06*** | (2006.01) |
| ***F41J 7/06*** | (2006.01) |
| ***F41J 11/00*** | (2009.01) |

(52) U.S. Cl.

CPC .... *F41J 2/02* (2013.01); *F41J 5/06* (2013.01); *F41J 7/06* (2013.01); *F41J 11/00* (2013.01)

(58) Field of Classification Search

CPC ..... F41J 1/10; F41J 2/02; F41J 5/06; F41J 5/14; F41J 5/18; F41J 7/06; F41J 9/00; F41J 3/00; F41J 3/02; F41J 5/02; F41J 5/04; F41J 5/08; F41J 5/10; F41J 5/12; F41J 5/24; G09B 9/003; G09B 9/006; F41G 3/26; F41G 3/2616; F41G 3/2694; F41A 3/00; F41A 3/02; F41A 3/06

USPC ..... 434/11–26

See application file for complete search history.

(56) References Cited

U.S. PATENT DOCUMENTS

| | | | | |
|---|---|---|---|---|
| 3,849,910 | A * | 11/1974 | Greenly | 434/22 |
| 4,260,160 | A * | 4/1981 | Ejnell et al. | 273/348.1 |
| 4,279,599 | A * | 7/1981 | Marshall et al. | 273/348.1 |
| 8,360,776 | B2 * | 1/2013 | Manard et al. | 434/23 |
| 2005/0153262 | A1 * | 7/2005 | Kendir | 434/21 |
| 2011/0042900 | A1 * | 2/2011 | Hutchinson et al. | 273/348.1 |

* cited by examiner

*Primary Examiner* — Timothy A Musselman

(74) *Attorney, Agent, or Firm* — M. A. Ervin & Associates; Michael A. Ervin

(57) ABSTRACT

A shooting target range assembly for use by a trainee marksman using IR night vision imaging equipment to view a target. The range may have at least one target support mechanism for supporting a target and an infrared (IR) light projector associated locally with the base for projecting an IR light locally onto the target to illuminate the target with substantially IR images. The night vision imaging equipment used is chosen to be compatible with the IR light projector chosen. The assembly detects projectile hits on illuminated targets from a projectile fired by a trainee marksman.

18 Claims, 4 Drawing Sheets

SHOOTING TRAINING ASSEMBLY WITH INFRARED PROJECTION

BACKGROUND OF THE DISCLOSURE

1. Field of the Invention

This invention relates to shooting training and relates particularly but not exclusively to training of military or other personnel with regard to shooting.

2. Description of Related Art

Shooting training for military personnel or other personnel requires highly varied and complex scenarios. In particular, training in night shooting is a particularly challenging endeavour. A common prior art approach comprised locally illuminating a target with a soft light that simulates moonlight. Typically, such soft light was coloured blue so that it did not appear as a bright colour. Trainee marksmen use their natural eyesight unaided with any vision enhancing apparatus. Typically, in a range used for the early examples of night shooting, targets were placed at particular positions simulating an offensive area. This included placing the targets in open paddocks or fields, or placing targets in a simulated village environment. The trainee marksmen then walked through the offensive area on the range and a range controller person activated the blue lights to provide soft lighting to discreet ones of the targets. Some of the targets may have included an image depicting an expected offensive image such as an attacking soldier or other like person who might provide confrontational aggressive response. Other expected images comprise images of children or women who are passive and not aggressive. Other images comprised pictures of offensive vehicles such as tanks or armoured personnel carriers. In these early prior art ranges, there was a distinct problem, in that there is a natural ambient light even at night time and the trainee marksmen is able to visually ascertain the location of the targets with the unaided human eye. Thus, any surprise element of a target image suddenly appearing was minimised, particularly for the trainee marksman who has a keen eye.

In other examples, a target range has been provided where there is a row of targets at a target firing location, and a remote infrared (IR) projector located at a position of trainee marksmen who are usually positioned in a bunker or like location. In such cases, the trainee marksmen wear IR night vision imaging equipment such as IR goggles. In some cases the marksmen can use similar night vision apparatus such as thermal or IR imaging monocular or binocular or weapon sighting devices. In such an environment, the trainee marksman knows the position of the targets, and the position of the projector, and is able to pre-ascertain the likely location of a particular target image. Further, because the IR projector has been positioned with the marksmen, the IR light beam, IR illuminates dust particles in the air as it travels to illuminate the targets. The marksmen are able to see a beam of IR light by noting the IR illuminated dust particles. The marksmen can then discern the position of the targets, and again a surprise appearance of a target is minimised. Thus, this later variation of night shooting has been unable to simulate real, combat like training. An example of a night shooting training apparatus of this type is disclosed in UK patent application GB 2067237. Another example is disclosed in U.S. Pat. No. 4,336,018.

In an attempt to provide more realistic combat training, it has been proposed that the trainee marksmen wear goggles or use thermal or IR equivalent sensing devices that remove the effects of ambient light that may otherwise partially illuminate the targets. In such cases, the targets are thermally heated and the trainee marksmen are able to discern the particular targets by the thermal response of the IR night vision imaging equipment. In such cases, the targets have been heated by wrapping the targets in a warm blanket. The targets are usually lowered to a position where they are out of view while they are heated by the blankets. When the target is to be placed in a position to be seen by the trainee marksmen, the blankets are removed and the targets held upright. The residual heat is then able to be detected by the IR night vision imaging equipment by virtue of the thermal output in the IR spectrum radiating from the target itself. This recent proposal is particularly useful in the case of providing targets that simulate offensive vehicles such as tanks or armoured personnel carriers. Such a system however, has enormous practical problems in heating the blankets, wrapping the targets in the blankets, removing the blankets, and subsequently erecting the targets into an upright position where they can be viewed. Typically, many personnel are required to effect the necessary heating of the targets in this way, and on a particular range there may be many such targets required. Thus, there is a problem of providing personnel in the target range firing area for each of the targets.

In a variation of the above proposal, electric heating elements have been placed into the target materials or onto the surface of the target itself to be heated by an electric current. A problem with such an arrangement is that one projectile can break the electric continuity of the heating circuit and thus the heating effect is destroyed immediately by a single penetration of the target.

There is thus a need for a practical and cost effective target practice assembly for training marksman in the use of night vision equipment. Such a system could be used in complete darkness or even in low light conditions.

This need can be met with a system based on infrared (IR) projection and associated imaging equipment such as goggles, binoculars, monoculars, and/or weapon sights. A cost effective system must take into account and balance both the current and possible future costs of IR projectors.

The terminology of night vision technologies can become confusing because it is sometimes loosely defined. For purposes of this specification the following terminology will be used.

Night vision technologies can be broadly divided into four main categories; normal night vision, image intensification, active illumination, and thermal imaging. All four are defined below although this specification will focus more on the last three.

Normal Night Vision:

Usually refers to binoculars or telescopes with a large diameter objective. Large lenses can gather and concentrate light, thus intensifying light with purely optical means and enabling the user to see better in the dark than with the naked eye alone. Often night glasses also have a fairly large exit pupil of 7 mm or more to let all gathered light into the user's eye.

Image Intensification:

Image intensification technologies (sometimes called light amplification) work on the principle of magnifying the amount of received photons from various natural sources such as starlight or moonlight that is not intense enough for the human eye to see unaided.

Active Illumination:

Active illumination technologies work on the principle of coupling imaging intensification technology with an active source of illumination (projectors) in various infrared bands. Active illumination is an aspect of the invention described herein.

Thermal Imaging:

Thermal imaging technologies work by detecting the temperature difference between background and foreground objects and usually does not require any other source of illumination. However.

Infrared systems can be divided into three spectral regions—near, mid, and far infrared. These are usually abbreviated as NIR, MIR, and FIR. Today's reality is that MIR/FIR projection systems are considerably more expensive than NIR projection systems. But MIR/FIR projection systems can be used with lower tech and less expensive imaging intensifying night vision goggles, binoculars, monoculars, and/or weapon sights. It should also be noted that thermal imaging technologies operate in the far infrared (FIR) and can thus be used in conjunction with FIR projections systems in an active illumination situation.

In this disclosure the term night vision imaging equipment will be used to refer to equipment such as for example goggles, binoculars, monoculars, and/or weapon sights used by individuals during training. This disclosure will focus primarily on image intensification systems and thermal imaging systems. Image intensification (also called sometimes II technologies and sometimes called light amplification) has evolved into a wide range of capabilities, each with different performance capability and cost. The lower levels are less expensive than thermal imaging. The higher levels can be as expensive as thermal imaging systems.

Most image intensification systems are not usable in daylight because all light wavelengths flood the viewfinder presenting a whiteout effect. But this might be addressed in future systems with added selected light wavelength filters.

Most near infrared (NIR) projection systems should be compatible with most image intensifying night vision equipment (goggles, binoculars, monoculars, and/or weapon sights) now available. If the particular NIR projection system chosen for this application is not completely compatible with standard image intensifying night vision equipment then modified image intensifying night vision equipment tailored to the particular NIR projector will be used. We refer to that as "modified" night vision equipment. The invention of this disclosure anticipates that several combinations of IR projector technologies in combination with multiple versions of night vision equipment might be used.

SUMMARY OF THE DISCLOSURE

An image projected onto a surface that function as a target in either NIR or MIR/FIR by a projector can be made to replicate the heat signature of humans, animals, motor vehicles & tanks etc when viewed through various night vision and thermal imaging goggles, binoculars, monoculars, and/or weapon sights. In the description and claims to follow the term night vision imaging equipment may refer to any of the simpler and lower cost night vision and thermal imaging goggles, binoculars, monoculars, and/or weapon sights or more advanced and costlier image intensifying night vision goggles, binoculars, monoculars, and/or weapon sights. It is important to note that the night vision equipment chosen (goggles, binoculars, monoculars, and/or weapon sights) is chosen to be most compatible with the infrared projection system chosen.

The aforementioned needs are met with a shooting target range assembly for use by a trainee marksman using night vision imaging equipment to view a target, the range having at least one target support mechanism for supporting a target, an IR light projector associated locally with the base for projecting an IR light locally onto the target to illuminate the target with substantially only IR lights that excludes substantially any projected light that may be visible to a human naked eye, an IR light activator to permit IR light from the IR light projector to illuminate the target or to project an image onto the target or to cease illuminating the target, or to cease projecting an image onto the target, a projectile hit detector for detecting a projectile hit on the target from a projectile fired by a trainee marksman, whereby at least one target support mechanism can be positioned at a desired location in the range and so the target will be non visible to a trainee marksman during night shooting using IR night shooting apparatus until such time as the IR light activator is activated to permit IR light from the locally associated IR light projector to illuminate the target, and wherein the projectile hit detector can provide an indication of a target hit by a projectile shot at the target by the trainee marksman when the target is illuminated by the IR light.

In another aspect in which the night shooting target range assembly utilizes an NIR projector then the night vision imaging equipment chosen has been modified to be compatible with that projector.

In another aspect in which the night shooting target range assembly utilizes an MIR/FIR projector then the night vision imaging equipment chosen has been modified to be compatible with that projector.

In another aspect of the shooting range assembly the IR light activator is operable to permit IR light to illuminate the target in response to a range control instruction.

In another aspect of the shooting range assembly the IR light activator is operable to permit IR light to illuminate the target in response to a proximity detector detecting the proximity of a trainee marksman to the proximity sensor.

In another aspect of the shooting range assembly the hit detector operates to cause the IR light activator to cease the illumination of the target immediately following a target hit, thereby signifying to the trainee marksman that the target has been hit.

In another aspect of the shooting range assembly the IR light activator is operable to permit IR light to cease to illuminate the target in response to a range control instruction.

The needs are also met with a method of training a marksman for night shooting using night vision imaging equipment, the method includes at least the steps of providing a target at a position on a target range, locally illuminating the target with substantially only IR light from an IR light projector that excludes substantially any light that may be visible to a human naked eye, the illumination being in response to operation of an IR light activator that permits IR light from the IR light projector to illuminate the target, or not to illuminate the target, detecting a projectile hit on the target when the target is illuminated, the projectile being fired at the target by the trainee marksman, and providing an indication of the target being hit in response to detecting the projectile hit.

In another aspect of the method includes the steps of providing range control instructions to the IR light activator to illuminate the target.

Another aspect of this method includes at least the steps of detecting the proximity of a trainee marksman to a proximity sensor and causing the IR light activator to permit IR light to illuminate the target in response to such detection.

Another aspect of this method includes at least the steps of causing the IR light activator to not illuminate the target following detecting a projectile hit on the target, thereby indicating to the trainee marksman that the target has been hit.

Another aspect of this method includes a projection of a moving object replicating the motion of a solider walking or tank driving etc. and responding appropriately after being shot. i.e. falling over or exploding etc.

Another aspect of this method includes at least the steps of causing the IR light activator to not illuminate the target in response to a range control instruction.

Another aspect of this method includes at least the steps of causing the IR light projector to switch ON by the IR light activator.

Another aspect of this method includes at least the steps of causing the IR light projector to switch OFF by the IR light activator.

Another aspect of this method includes at least the steps of providing the target with a surface area of greater IR light reflectivity than another surface area thereof, the surface area being shaped to define an expected target heat image on the target from the illumination.

Another aspect of this method includes at least the steps of providing a projected IR light image from the IR light projector that will reproduce a target image on the target from the illumination.

Another aspect of this method includes at least the steps of having multiple images that can be projected from the IR light projector, at least one of those multiple images being an expected target image, and selecting one of those multiple images and projecting an IR light image of the selected one of those images to reproduce on the target.

In another aspect of this method one of the multiple images may be a non-aggressive image, and selecting the non-aggressive image and projecting an IR light image of the non-aggressive image to be reproduced on the target.

Another aspect of this method includes at least the steps of noting any target hits while a non-aggressive image is reproduced on the target.

The needs can also be met by a target support mechanism for holding a marksmanship target for use in a shooting range, the target support mechanism having a base for positioning on a surface, the mechanism having a target clamping means for clamping a lowermost part of a target to the target support mechanism so the target will be upstanding from the target support mechanism, the target support mechanism having a mass that will allow the target to be maintained supported upstanding on the target range when the target is subject to moderate winds, the target support mechanism having an IR light projector mounted locally therewith and arranged to direct projected IR light therefrom onto a face of the target held thereby, the IR light being substantially only IR light that excludes substantially any projected light that may be visible to a human naked eye, the target support mechanism having a projectile hit detector, for detecting a projectile hit on the target from a projectile fired by the trainee marksman.

In another aspect this target support mechanism includes at least a processing circuit for obtaining a hit signal from the projectile hit detector and for operating an IR light activator to cease illumination of the target following a hit of the target being detected.

In another aspect this target support mechanism includes at least a processing circuit for receiving a signal to operate an IR light activator to allow illumination of the target in response to the signal.

In another aspect this target support mechanism includes at least a processing circuit for receiving a signal to operate an IR light activator to not allow illumination of the target in response to the signal.

In another aspect this target support mechanism the IR light projector is mounted within a shield that protects the IR light projector from being hit by projectiles shot at the target.

In another aspect this target support mechanism the shield is provided with surfaces angled to deflect projectiles away from the IR light projector.

The needs can also be met by a target for night shooting training, the target having a surface area of greater IR light reflectivity than another surface area thereof, the surface area being shaped to define an expected target thermal image when illuminated by substantially only IR light, the expected target image, when illuminated, being viewable by a trainee marksman using an IR night sighting apparatus.

The described system is new with respect to other target training systems in that it presents targets that are visible only through night vision goggles or weapon sights or thermal imaging goggles and weapon sights. This makes the system ideal for night weapon training but can also be used in low light conditions.

BRIEF DESCRIPTION OF THE SEVERAL VIEWS OF THE DRAWING

In order that the invention can be more clearly ascertained examples of preferred embodiments will now be described with reference to the accompanying drawings wherein.

DETAILED DESCRIPTION

Figure 1:
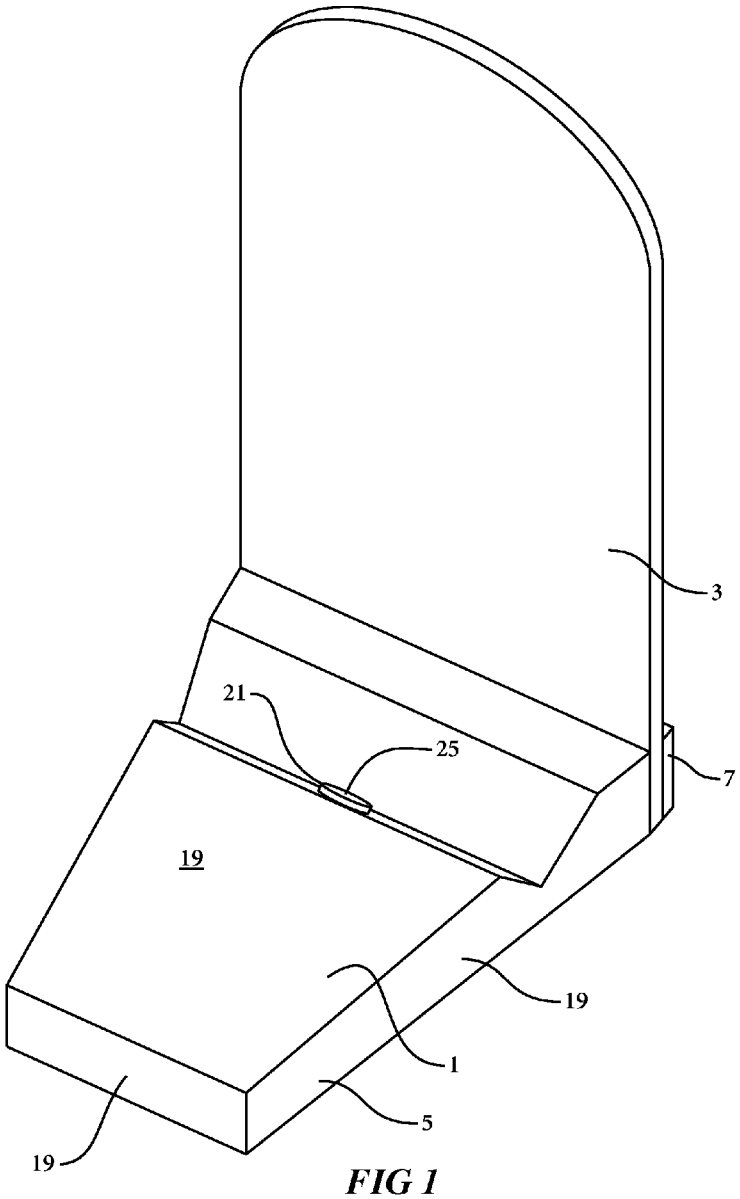
FIG. 1 is a front perspective view of a proposed target support mechanism supporting a target.

Referring firstly to FIG. 1, there is shown a target support mechanism 1 that supports a replaceable target 3. Typically the target 3 is a known infantry target or other target such as a thermoplastic target that has partial self sealing properties when penetrated by a projectile. The target 3 is generally planar and may be provided with upright corrugations (not shown) to provide rigidity. The rigidity is required to enable projectile hit shock wave transference to be transmitted from the target itself to a hit detector associated with the target support mechanism. The corrugations also provide rigidity to the target material to inhibit the target from sagging under extreme weather conditions such as high heat. The target face may be bowed inwardly or outwardly to further provide stability against sagging and to increase rigidity for hit shock transference characteristics. All of these features relating to the targets are well known. While a thermoplastic infantry target has been referred to, other targets may be utilised such as, for example, paper targets, cardboard targets, metal targets, wooden targets, smoke screen targets, water vapour targets and the like. All of these types of targets are known per se and are not considered part of the present invention.

Because this shooting target assembly is compact and self contained it can be used in multiple arrays on live fire ranges or individually randomly deployed in forest, jungle, or simulated urban environments.

Target 3 can be simply reflective an present a projected illumination or can have a paint or other coating—e.g. reflective coating or coating that results in an image resembling the required target object e.g. soldier, vehicle, animal etc when illuminated by IR light from immediately in front of the target & out of the intended line of fire. The image will be immediately visible when viewed through either normal night vision and thermal imaging goggles, binoculars, monoculars, and/or weapon sights or modified image intensifying night vision equipment such as a monocular device, binocular device, gun sight or other sighting and aiming devices designed for night use.

But in addition the target image can be a more sophisticated projected image from the IR projector device and could have multiple images or even moving images, depending on the IR projection technology. This can be provided by changing a transparency or electronically generated image in front of an IR projector source. One of the preferred embodiments might make use of DLP, DDP, or DDC microchip devices to project varying images onto a target board.

Figure 2:
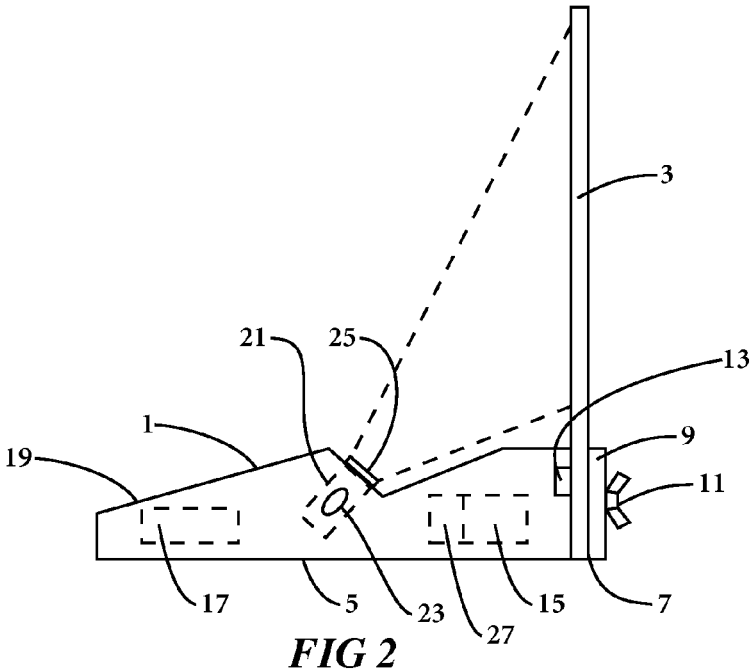
FIG. 2 is a side elevation view of the target support mechanism and target shown in FIG. 1.
Figure 3:
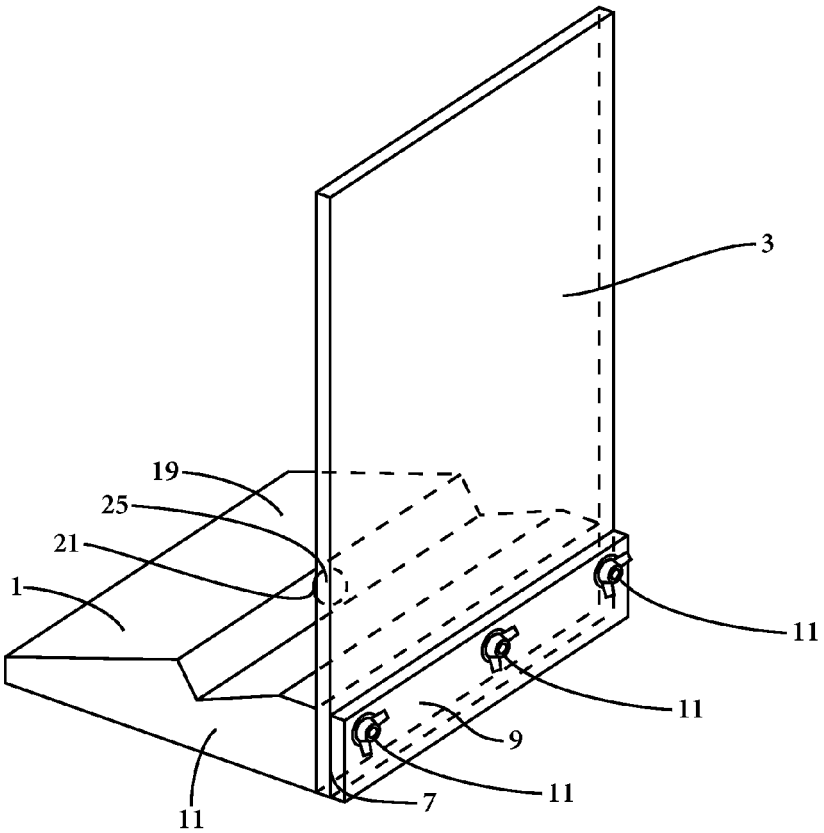
FIG. 3 is a rear perspective view of the target support mechanism and target shown in FIG. 1.

The target support mechanism 1 provides the target 3 upstanding relative to a base 5 of the target support mechanism 1. The base 5 enables the target to be positioned on a surface such as on the ground or other like surface. The mass of the target support mechanism 1 is sufficiently high to provide stability to target support mechanism 1 and the mounted target 3 during normally expected wind loadings that may occur. In such case, the mass of the target support mechanism will hold the target 3 in an upright condition without toppling over. The target support mechanism 1 has a releasable target clamping means 7 for releasably clamping the target 3 relative to target support mechanism 1. FIGS. 2 and 3 show that the target clamping means includes a bar 9 and a number of thumbnuts 11. In such an arrangement the target 3 is held at its lowermost positions to stand in an upright or an erect condition. When the target requires replacement thumbnuts 11 can be undone and the target can be removed. A new target 3 can then be fitted and the thumbnuts 11 retightened.

The target support mechanism 1 includes a hit sensor device 13 (see FIG. 2) that is able to respond to the hit shock impact wave consequent on a projectile, such as a bullet striking target 3 and generally penetrating target 3. Typically, hit sensor device 13 comprises a piezoelectric sensor that provides a hit output signal in response to a target hit. The hit sensor device 13 is connected with electronic processing circuitry 15 to process the hit signal and to determine if the hit signal has exceeded a particular threshold level. If the threshold level is exceeded, then a hit signal is registered. The electronic processing circuitry 15 typically includes a radio transmitter device (not shown) that radios a hit signal back to a range controller to inform the range controller of hits on the target. The electronic processing circuitry 15 is powered from an internal battery 17 mounted within an outer casing 19 of target support mechanism 1. Typically casing 19 is angled relative to the direction of an approaching projectile to target 3 so as to deflect projectiles off target support mechanism 1.

In a variation of the above known target support mechanism, target 3 may be mounted relative to target clamping means 7 so that the target can swing generally forwardly or rearwardly from an erect position to a collapsed position. A particular arm and motor drive mechanism may be provided to effect such swinging. A mechanism of this type is also considered to be suitable for use in the present invention.

FIGS. 1-3 clearly show the use of a local IR light projector 21 relative to the target 3. Here, the IR light projector includes an IR light source 23 (see FIG. 2) and a projecting lens 25. IR light projector 21 is able to project IR light locally onto target 3 so as to illuminate target 3 with substantially only IR light that excludes substantially any projected light that may be visible to a human naked eye. Thus, the particular IR light source 23 may be provided to produce a light output of this type directly, or alternatively filters (not shown) may be provided to suppress the transmission of any light that may be visible to a naked human eye. FIG. 3 exhibits how light is projected from the IR light projector 21 onto the face of the target 3. In this case the IR light is outside of the visible wavelength response of a human naked eye. The target face of the target 3 therefore acts like a screen to display an area of IR light corresponding to the area projected from the IR light projector 21. In one example, the IR light projector 21 may be an IR diode. In another case it may be a conventional lamp operating at a temperature to provide substantially only IR light output with substantially no visible wavelength light that can be perceived and viewed by a human naked eye. In order to provide a high intensity IR image onto the face of the target 3, it is desirable to use an IR light projector 21 with an IR light source 23 that provides maximum light output in the IR wavelength spectrum only.

FIG. 2 shows the inclusion of an IR light activator circuit 27 that can provide switching of electrical current to the IR light source 23. This, in turn, will enable the IR light source 23 to be turned ON, or turned OFF. Thus, in such cases the IR light activator 27 will permit IR light to be projected from the IR projector 21 to illuminate the target 3, or to cease illuminating the target 3.

When a trainee marksman wears night vision goggles or uses other night vision imaging equipment to view the range, the target 3 will be invisible even if subjected to low levels of ambient light that occurs during night time. It is only when the IR light projector 21 is activated to project IR light by operation of the IR activator circuit 27 that target 3 becomes visible through the night vision imaging equipment. Accordingly, in such conditions, the trainee marksman can fire upon target 3. If a projectile fired by the trainee marksman hits target 3 it will cause a shockwave to travel down target 3 to activate hit sensor device 13. This, in turn, will trigger electronic processing circuit 15 to indicate a target hit. Typically, IR activator circuit 27 can be activated remotely such as by a radio or other like transmitting means to allow IR light source 23 to switch ON or to switch OFF. Thus, a range controller person can send range control instructions by selectively switching ON the IR light projector 21 to enable a particular target 3 to be illuminated and become visible for the trainee marksman. The same range controller person can then forward similar range control instructions to the IR activator circuit 27 to switch OFF the IR light projection so that target 3 then becomes invisible to the trainee marksman. In a range where there are multiple target support mechanisms 1 and targets 3, a range controller person can provide more realistic training than in the past and can simulate surprise appearances of targets.

IR activator circuit 27 has been described above as permitting switching ON or OFF of IR light source 23. In an alternative arrangement, a blind or chopper wheel may be provided to interrupt the passage of IR light transmitted from IR light source 23 through lens 25 and onto the target 3. In this way, the light source 23 may be continuously ON and the blind or chopper wheel activated to enable the IR light to transmit or not transmit.

FIG. 1 can show a particularly aggressive person as an offensive target image displayed on the face of the target 3. Here, a transparency slide image may be associated with IR light projector 21 so that the particular IR thermal image displayed on the face of target 3 will be a particular target image required for night shooting training. The transparency or slide may be one of a multitude of possible transparencies or slides that can be activated to selectively display the respective images on the face of target 3. Details of such have not been provided in this description as it is considered that this is, in itself, a known means of providing different images onto projected surfaces. In a variation of this, IR light projector 21 may be a data or image projector device to which signals may be supplied which provide picture images in IR light projector 21 that can then be provided onto the face of the target 3 as the displayed target image. Thus, in FIG. 1, target 3 will have a plane coloured face such as a black or white or other coloured face. The projected IR image will then be visible through the night vision imaging equipment.

Figure 4:
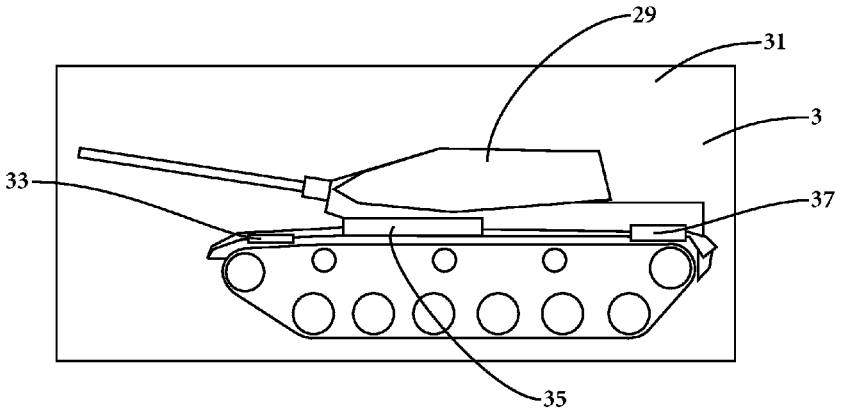
FIG. 4 is a front face view of a target incorporating a particular target example image representing an offensive vehicle.

FIG. 4 shows a variation of a target 3. Here, target 3 is relatively large and is of a size to depict a real life size of an offensive vehicle such as a tank or armoured vehicle carrier. FIG. 4 shows a particular offensive tank image 29. The tank image 29 may be projected directly from the IR light projector 21 or may be provided as an image already pre-prepared onto the surface of the target 3. In this case, the target image 29 can be of a more IR thermal reflective colour than the general background area 31 of the target face. FIG. 4 also shows a further area 33 that may represent, for example, an engine compartment of the tank image. A further area 35 is shown representing general internal heat radiation from the tank image 29. A further area 37 is shown depicting an exhaust pipe. Thus, by selectively providing discreet areas on the face of the target 3 that have reflective properties that will enhance display expected high heat output areas of a required target image 29, one can more closely simulate a real life training environment than in the past. The general image 29 may be projected directly from the IR light projector 21, and that image enhanced with the particular areas 33, 35 and 37. Alternatively, the whole of the target face 31 may be illuminated with IR light from the IR light source 23 to expose a pre-provided image 29 on the target face of target 3. In such cases, the particular areas 33, 35, 37 will provide a simulation of anticipated high thermal heat output from a real life target.

In one example, a range controller person may activate IR light projector 21 to project IR light onto the target 3, and then, if a target hit is detected, the hit can be processed by the electronic processing circuitry 15 to activate the IR activator circuit 27 to turn OFF the projection of the IR light onto the face of the target 3. In this way, the image 29 on the target 3 will be visible only when IR light is projected from the IR light projector 21. When the trainee marksman fires a projectile at the target and hits the target, the hit detection circuitry can sense the hit and switch OFF the light projection from the IR light projector 21. Thus, the image will then disappear from the face of the target 3. This will give the trainee marksmen a direct indication that the target has been hit.

Figure 5:
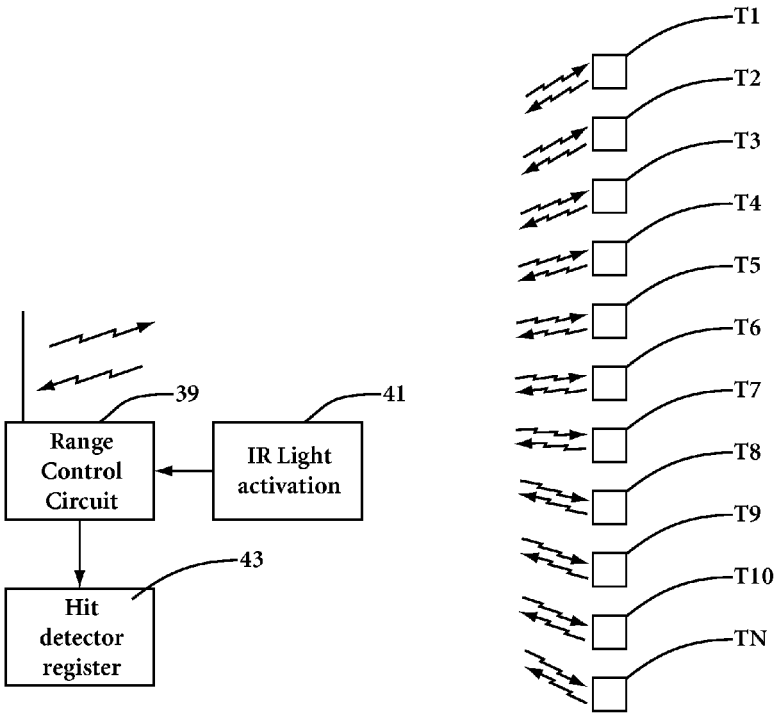
FIG. 5 is a block schematic diagram showing an example of a particular target range incorporating a number of target support mechanisms and range control circuitry and IR light activation components.

FIG. 5 shows a diagrammatic circuit layout diagram of target support mechanism $T_1$-$T_N$ which can be selectively located at particular positions on a target range. While the target support mechanisms have been shown arranged in line in FIG. 5, this is for illustrative purposes only. In a typical installation, the target support mechanisms $T_1$-$T_9$ can be placed at random positions throughout a training range to simulate a likely combat area. This may comprise placing the target support mechanisms in fields or paddocks and/or villages or particular internal areas such as in buildings. In each case, the target support mechanisms $T_1$-$T_9$ include a two way communication system to receive IR light activation control signals from a range control circuit 39. The communication system also enables hit detection signals to be transmitted back to the range control circuit 39. This is diagrammatically shown at each one of the target support mechanisms $T_1$-$T_9$ by the jagged lines. FIG. 5 shows that a range controller person can manually control operation of the target range itself. A range control circuit 39 of this type for prior art night shooting is generally known. Range control circuit 39 in this example may have an associated IR light activation circuit 41 that has a program recorded to enable selective operation of any one of the target support mechanisms $T_1$-$T_9$ to cause activation of the respective IR activator circuits 27, and the subsequent operation of IR light projectors 21 to illuminate the particular targets 3. The range control circuit 39 also has a hit detector register 43 whereby hits on the respective targets of the target support mechanisms $T_1$-$T_9$ can be recorded so there can be a subsequent display of target hits. A hit detector register 43 is a known part of existing range control circuit 39 and is in itself not considered a part of this invention.

Figure 6:
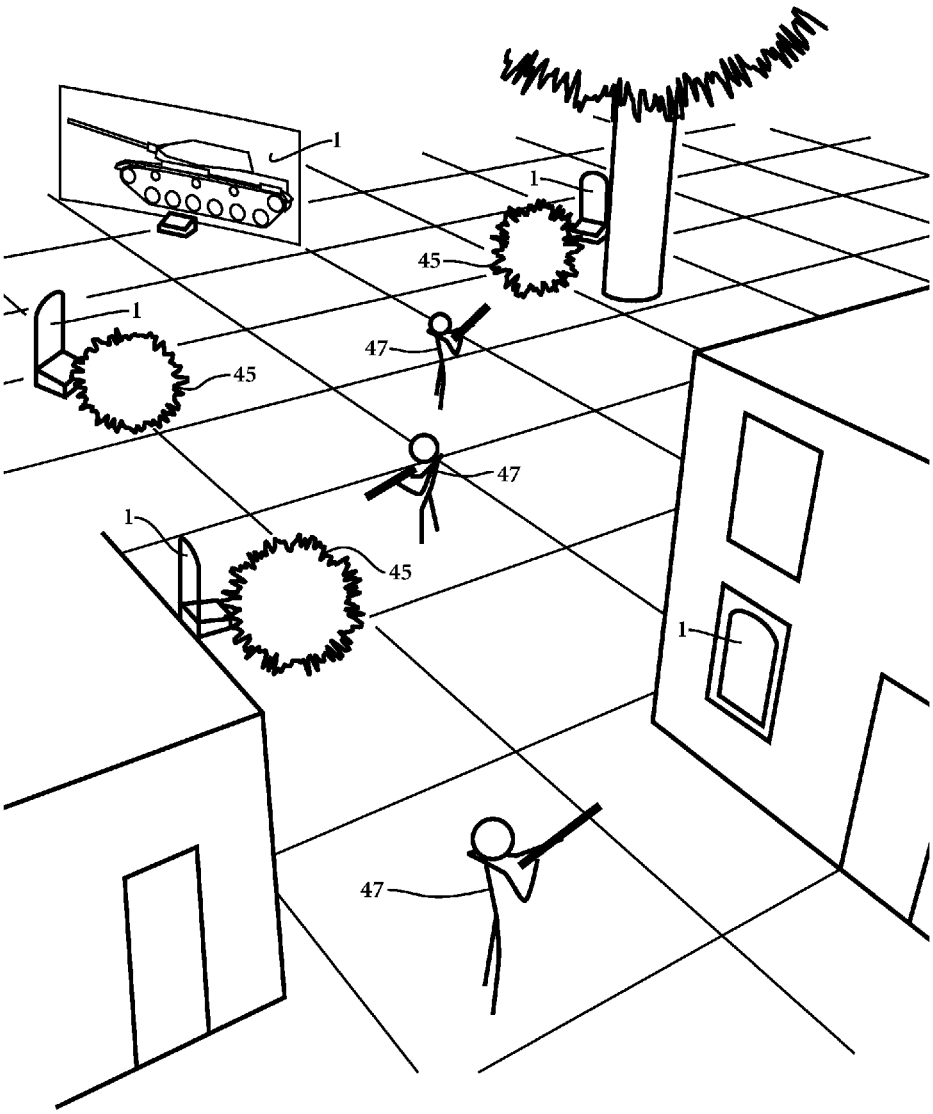
FIG. 6 is a diagrammatic view illustrating one example of a particular range layout utilising target support mechanisms and targets of an example.

Referring now to FIG. 6 there is shown a typical range layout that simulates a possible offensive environment in which training is to occur. Here, there are a number of target support mechanisms 1 placed at discreet locations in the range area. The target support mechanisms 1 and associated targets 3 may be shielded by mounds of dirt or the like or may be partially hidden by foliage. This has been diagrammatically represented by numeral 45. Trainee marksmen 47 are provided with either normal night vision and thermal imaging goggles, binoculars, monoculars, and/or weapon sights or modified image intensifying night vision goggles, infrared binoculars, monoculars, and/or weapon sights. Under such conditions, the general background of the range will be invisible as the trainee marksmen 47 will be able to see only via the night vision imaging equipment. In such cases, a range controller person can selectively cause illumination of individual ones of the target support mechanisms 11. In this way, the trainee marksman 47 will have a more realistic surprise appearance of an offensive target than with known systems. In some cases, the image displayed on target 3 may be an aggressive offensive target image, or a passive target image of a woman or child or the like.

From the above, it can be seen that the concepts make use of known target training equipment and targets but modify that known target training equipment, in a very simple way to achieve a result not previously obtained.

Modifications may be made to the examples referred to above without departing from the inventive concepts. For example, the target support mechanism 1 may be made portable such that they can be moved to particular locations on a range as required by a range controller person. If desired, the target support mechanisms 1 may be made permanent fixtures at discreet locations in a target range. The IR light projector 21 may be a retrofit device to existing target support mechanisms 1. Thus, the inventive concepts can be implemented economically in existing target ranges without the need to replace target support mechanisms 1.

In a variation, each one of the target support mechanisms 1 as shown in FIG. 5 (being presented by target support mechanisms $T_1$-$T_N$) may be connected with a proximity sensor linked to the IR activator circuit 27. Thus, in such a situation, when a trainee marksman 47 arrives in proximity to a particular one of the target support mechanisms $T_1$-$T_N$, the target will be illuminated by operation of the IR activator circuit 27 to cause the IR light projector to project IR light onto the surface of the target 3. This will provide enhanced realistic training simulation than in past systems.

In a variation of the target surface material, and particularly in the case of large target images such as tank targets, there may be an inflatable balloon type target 3 onto which the IR image can be projected. Hit sensing is usually detected in such known target support mechanisms 1 by detecting a change in air pressure within the inflated target. This occurs on passage of a projectile through the target itself. Other forms of hit detection are also known for use with inflatable and other targets. Further, ultrasonic airwave pressure sensing sensors may be utilised at the target 3 to detect the airwave pressure shockwaves as a projectile passes an ultrasonic sensor device. Such sensor devices are known for use with target support mechanisms 1.

While physically solid or rigid targets have been particularly described above, other forms of targets such as paper targets, or smoke screens, or vapour curtains may be utilised. In such cases, other known target hit detection devices known in the art can be utilised. In one such case, laser beams may be used to scan immediately in front of or behind the target 3 and detect the passage of the projectile. This can, in turn, be used to signal a target hit by the projectile.

The IR activator circuit 27 (see FIG. 2) may include a feature to provide a signal to the electronic processing circuitry 15 to only permit the recording or detection of hit signals onto the target 3 when the IR light projector 21 is actually projecting light onto the target 3. In this way, if a projectile should strike the target 3 when the IR light projector 21 does not illuminate the target the hit will not be registered. Thus, if a trainee marksman is to see the particular IR image of the target 3 when the IR light projector 21 is illuminating the target 3, and then if the trainee marksman fires at the target when the IR light projector 21 is not illuminating the target, then the hit will not be registered. This may signify visually to the marksman that the target has actually disappeared and that he has shot a wasted round at the target.

Further, in the case where a visual image is provided on the target 3 that represents a non-aggressive target such as a woman or child or other civilian person, or the like non-aggressive image, a hit recording can be detected and assigned to the non-aggressive target image being displayed. This will signify that the particular trainee marksman has fired at an unintended target.

In a further example, the image that is projected onto the face of the target 3 may be a motion video target image. In this case, a number of still picture images may be sequentially displayed showing the target in slightly different positions. Alternatively, in the case where IR light projector 21 is a video projector or a DLP projector appropriate digital image signals may be used to define a particular moving target image. In that way, the projection of the IR light to illuminate target 3 will provide a target image on the face of target 3 representing a moving video image. This will aid realistic training of marksmen.

These and other modifications may be made without departing from the invention, the nature of which is to be determined from the foregoing description and the appended claims.

The invention claimed is:

1. A night shooting target assembly for use by a trainee marksman using night vision imaging equipment to view a target, comprising:

a. at least one target support mechanism for supporting a target;

b. an infrared (IR) light projector associated locally with said target support mechanism for projecting an IR light locally onto the target to illuminate the target with substantially only IR lights that excludes substantially any projected light that may be visible to a human naked eye;

c. an IR light activator to permit IR light from the IR light projector to illuminate the target or to cease illuminating the target;

d. a projectile hit detector for detecting a projectile hit on the target from a projectile fired by a trainee marksman;

e. whereby at least one target support mechanism can be positioned at a desired location in the range and so the target will be non visible to a trainee marksman during night shooting using IR night shooting apparatus until such time as the IR light activator is activated to permit IR light from the locally associated IR light projector to illuminate the target, and wherein the projectile hit detector can provide an indication of a target hit by a projectile shot at the target by the trainee marksman when the target is illuminated by the IR light.

2. The night shooting target assembly of claim 1 wherein said IR light projector is an NIR projector and the night vision imaging equipment chosen has been modified to be compatible with that projector.

3. The night shooting target assembly of claim 1 wherein said IR light projector is a mid infrared/far infrared projector and the night vision imaging equipment chosen has been modified to be compatible with that projector.

4. The night shooting target assembly of claim 1 wherein said IR light projector is a mid infrared/far infrared projector and the night vision imaging equipment chosen is based on thermal imaging.

5. The night shooting target assembly of claim 1 wherein said night vision imaging equipment has added selected light filters to eliminate daylight wavelengths.

6. A method of training a marksman for night shooting using IR night vision imaging equipment, comprising the steps of:

a. providing a target at a position on a target range;

b. locally illuminating the target with substantially only IR light from an IR light projector that excludes substantially any light that may be visible to a human naked eye, said illumination being in response to operation of an IR light activator that permits IR light from the IR light projector to illuminate the target, or not to illuminate the target;

c. detecting a projectile hit on the target when the target is illuminated, said projectile being fired at the target by the trainee marksman; and d. providing an indication of the target being hit in response to detecting the projectile hit.

7. The method of training a marksman for night shooting using IR night vision imaging equipment of claim 6 further comprising providing range-control instruction to the IR light activator to illuminate the target.

8. The method of training a marksman for night shooting using IR night vision imaging equipment of claim 6 further comprising detecting the proximity of a trainee marksman to a proximity sensor and causing the IR light activator to permit IR light to illuminate the target in response to such detection.

9. The method of training a marksman for night shooting using IR night vision imaging equipment of claim 6 further comprising causing the IR light activator to not illuminate the target following detecting a projectile hit on the target, thereby indicating to the trainee marksman that the target has been hit.

10. The method of training a marksman for night shooting using IR night vision imaging equipment of claim 6 further comprising causing the IR light activator to not illuminate the target in response to a range control instruction.

11. The method of training a marksman for night shooting using IR night vision imaging equipment of claim 6 further comprising causing the IR light projector to switch ON by said IR light activator.

12. The method of training a marksman for night shooting using IR night vision imaging equipment of claim 6 further comprising causing the IR light projector to switch OFF by said IR light activator.

13. The method of training a marksman for night shooting using IR night vision imaging equipment of claim 6 further comprising providing the target with a surface area of greater IR light reflectivity than another surface area thereof, the surface area being shaped to define an expected target heat image on the target from the illumination.

14. The method of training a marksman for night shooting using IR night vision imaging equipment of claim 6 further comprising providing a projected IR light image from the IR light projector that will reproduce a target image on the target from the illumination.

15. A target support mechanism for holding a marksmanship target for use in a shooting range, comprising:

a. a base for positioning on a surface;

b. a target clamping means for clamping a lowermost part of a target to the target support mechanism so the target will be upstanding from the target support mechanism;

c. said target support mechanism having an IR light projector mounted locally therewith and used to direct projected IR light therefrom onto a face of the target held thereby illuminating the target with substantially only IR light from an IR light projector that excludes substantially any light that may be visible to a human naked eye, said illumination being in response to operation of an IR light activator that permits IR light from the IR light projector to illuminate the target, or not to illuminate the target;

d. a projectile hit detector, for detecting a projectile hit on the target from a projectile fired by the trainee marksman.

16. The target support mechanism of claim 15 further comprising a processing circuit for obtaining a hit signal from the projectile hit detector and for operating an IR light activator to cease illumination of the target following a hit of the target being detected.

17. The target support mechanism of claim 15 comprising a processing circuit for receiving a signal to operate an IR light activator to allow illumination of the target in response to said signal.

18. The target support mechanism of claim 15 comprising a processing circuit for receiving a signal to operate an IR light activator to not allow illumination of the target in response to said signal.

* * * * *